US005428514A

United States Patent [19]

Fink, Jr.

[11] Patent Number: 5,428,514

[45] Date of Patent: Jun. 27, 1995

[54] HANDHELD AEROBIC SAFETY LIGHT

[76] Inventor: Robert N. Fink, Jr., 2487 Settlers Ct., Snellville, Ga. 30278

[21] Appl. No.: 154,872

[22] Filed: Nov. 18, 1993

[51] Int. Cl.[6] ..... A63B 21/075; F21V 33/00

[52] U.S. Cl. ..... 362/183; 362/184; 362/253; 362/234; 482/108

[58] Field of Search ..... 362/253, 190, 202, 399, 362/196, 234, 183, 184; 482/106, 108

[56] References Cited

U.S. PATENT DOCUMENTS

| | | | |
|---|---|---|---|
| 2,219,906 | 10/1940 | Pummill | 362/202 |
| 4,559,588 | 12/1985 | Englson | 362/196 |
| 4,566,690 | 1/1986 | Schook | 482/106 X |
| 4,631,646 | 12/1986 | Spindler | 362/196 |
| 5,086,377 | 2/1992 | Roberts | 362/253 |
| 5,135,454 | 8/1992 | Yeh | 482/108 |
| 5,242,350 | 9/1993 | Chang | 482/108 |
| 5,286,244 | 2/1994 | Wright et al. | 482/108 |

*Primary Examiner*—Ira S. Lazarus
*Assistant Examiner*—Thomas M. Sember
*Attorney, Agent, or Firm*—Kenneth S. Watkins, Jr.

[57] ABSTRACT

An aerobic hand held safety light is disclosed which improves the visibility of a walker, runner, or jogger at night or in periods of reduced visibility. The device is oblong in shape and incorporates a lighting means visible from the front, back, or sides. A switch is provided to activate the lighting means. The device includes an attaching means for various size weights to be attached to the device without obstructing the lighting means.

11 Claims, 4 Drawing Sheets

HANDHELD AEROBIC SAFETY LIGHT

BACKGROUND

This invention relates to a handheld aerobic safety light for runners, joggers, and walkers which also provides attachments for weights to enhance the aerobic effects of the workout.

Increased public awareness of the importance of health and physical fitness has led to an increase in the number of people running, jogging, and walking. Unfortunately, increases in automobile and other vehicular traffic, especially in urban and residential areas has led to an ever increasing possibility of serious injury or death due to accidents. This danger is heightened at night or periods of reduced visibility.

A number of devices have been used in the past to improve the visibility of walkers, runners, and joggers. Reflective apparel, including hats, clothing, gloves, and footwear are frequently utilized, but these suffer the drawbacks of reduced flexibility, poor ventilation, and personal discomfort, and are effective only when an external light source is directed on the user. They are ineffective in many instances including in a curve or bend of a road where the headlights of an automobile are directed outside the path of a person. Active lighting devices such as common flashlights are used, but suffer the drawbacks of little or no visibility from the side or behind the user, and arm and hand fatigue due to inadequate gripping surfaces. Furthermore, the use of a common handheld lighting device precludes the use of handheld aerobic devices such as dumbbells.

The general object of the present invention is to provide a handheld safety device for walkers, runners, and joggers, which addresses the aforementioned drawbacks of existing devices. It is a further object of the present invention to provide a handheld aerobic device which permits attachment of weights to increase the aerobic effects for walkers, runners, and joggers.

SUMMARY

My present invention is a handheld aerobic safety device comprising an oblong shaped housing. Two lenses for dispersing light in a plurality of directions are attached to the housing, one at the front end and one at the back end of the housing. Two removable dumbbell weights, each having an opening of sufficient size to allow placement over the lenses, are attached to the housing so that the lenses extend outward from the housing beyond the dumbbell weights. The attachment of the dumbbell weights in this manner result in light dispersed from the lenses that is visible from the front, back, and sides with the dumbbell weights secured to the housing. The attachment means of the lenses is separate from the attachment means of the dumbbell weights so that the dumbbell weights can be removed and the lenses remain attached to the housing.

Alternative embodiments of the present invention comprise a "U" shaped handle, and "L" shaped handle, and a strap for aiding in holding the device. Other embodiments of the invention comprise an electric light bulb as a light source in the housing, a reflector at an end of the housing to concentrate the light of the bulb, and a transparent center portion in the lens to allow dual use as a conventional flashlight.

BRIEF DESCRIPTION OF THE DRAWINGS

These and other features, aspects, and advantages of the present invention will become better understood with regard to the following description, appended claims, and accompanying drawings where:

DESCRIPTION

Figure 1:
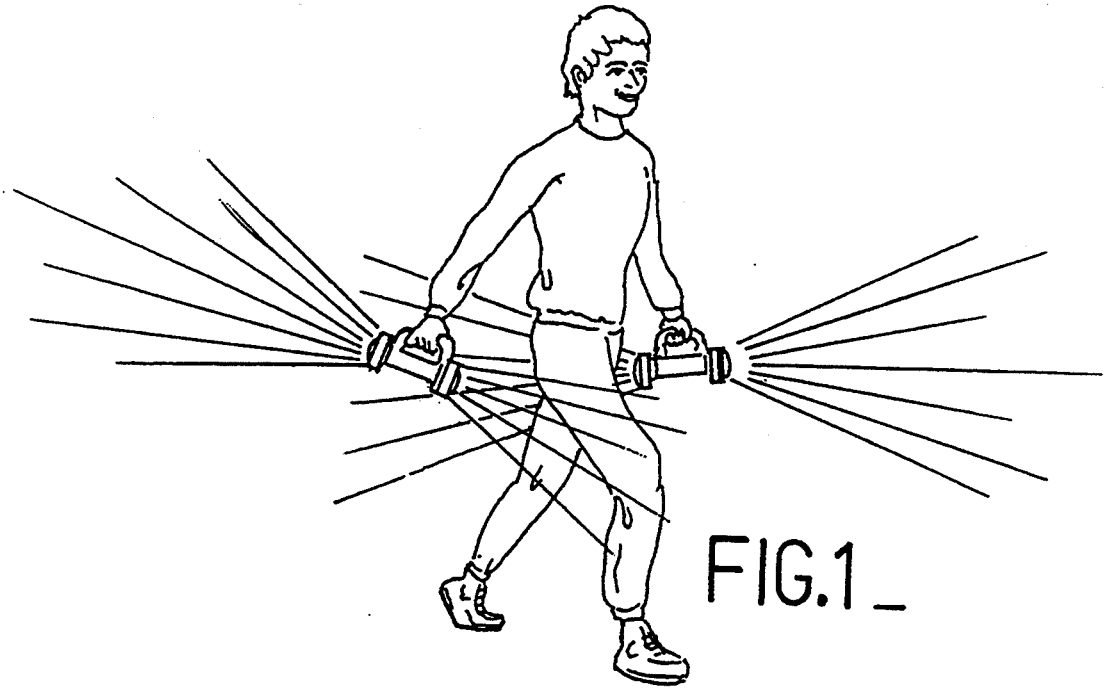
FIG. 1 is a pictorial view of the Safety Light in use.
Figure 2:
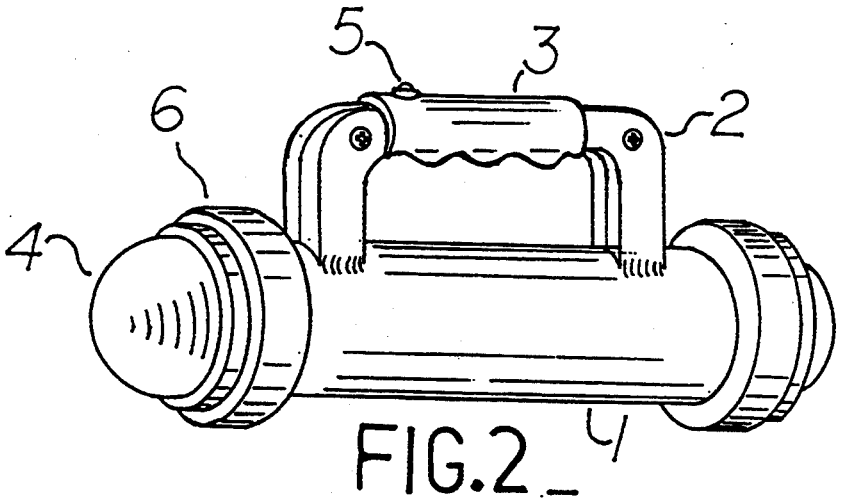
FIG. 2 is a perspective view of the preferred embodiment of the present invention.
Figure 3:
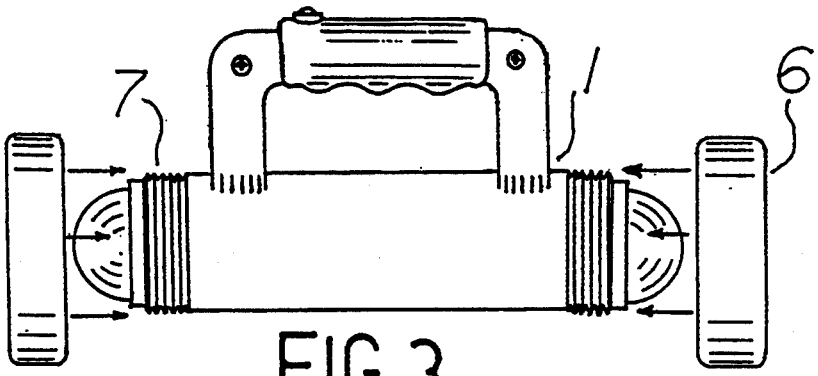
FIG. 3 is an elevation view showing assembly of weights to the preferred embodiment.
Figure 5:
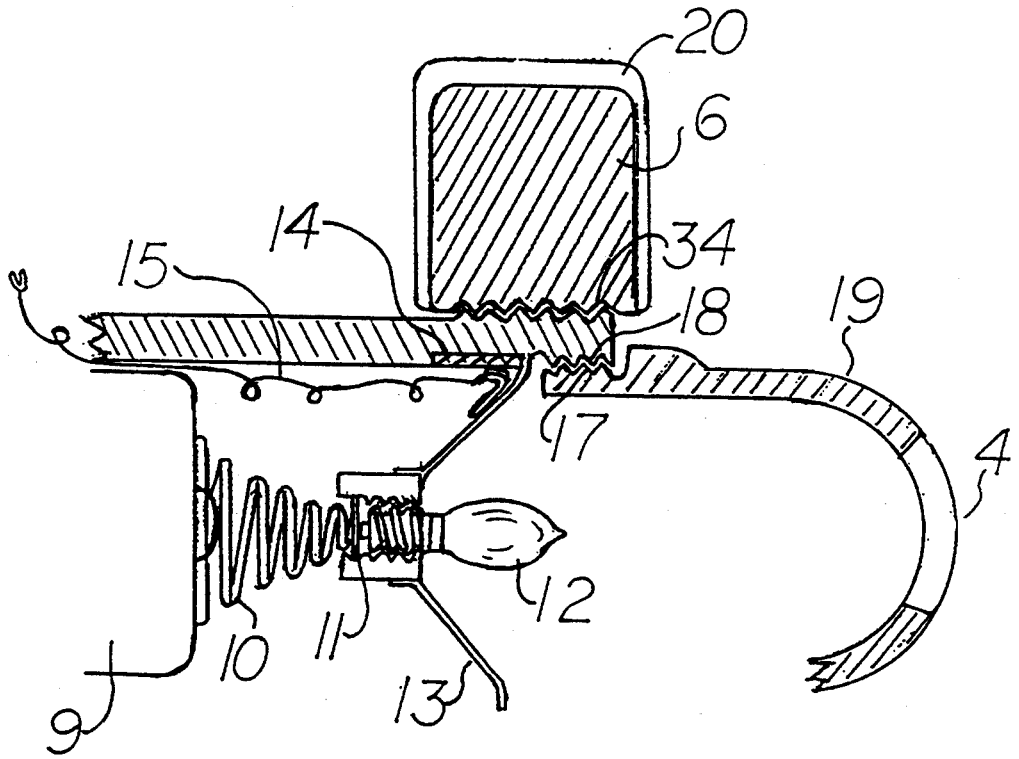
FIG. 5 is a sectional detail of FIG. 4.

A safety light in accordance with the present invention shown in FIG. 2 comprises a housing 1, which may be of a brightly colored or highly reflective material, a U-shaped handle 2, which may be integral with the housing, a grip 3 which may be integrally formed with the handle 2, a lens 4 of transparent and/or translucent material and of sufficient length so as to be visible in a hemisphere of approximately 180 degrees, a switch 5 for switching the light on or off as desired, and weights 6 which may be attached to either end as desired. Weights 6 are generally cylindrical in shape and may be of various sizes to meet different aerobic requirements. Weights 6 are assembled as shown in FIG. 3 by engaging internal threads 34 of weights 6 (see FIG. 5) to matching external threads 7 on either end of housing 1. Weights may be covered with a resilient covering 20 (see FIG. 5) to protect surfaces from marring.

Figure 4:
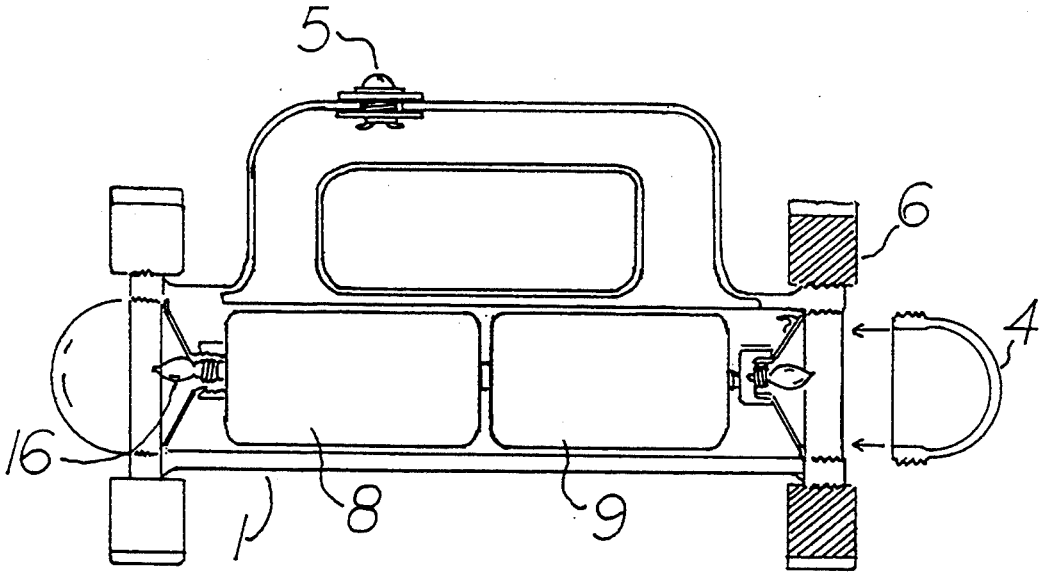
FIG. 4 is a cross section of the preferred embodiment.

Internal construction of the preferred embodiment is shown in sectional view FIG. 4. Battery cells 8 and 9 are inserted in housing 1. Contact with the base terminal of battery 9 is made with spring 10, see section detail FIG. 5, which through contact diaphragm 11 makes electrical and mechanical contact with the end terminal of electric light bulb 12, retained by engaging screw threads of bulb with matching threads in reflector 13. The reflector is retained radially in housing I by contact ring 14, providing electrical contact to conductor 15 which is connected to switch 5. The reflector is retained axially by lens 4 whose external threads 17 are engaged by body housing internal threads 18. A translucent material 19 may be utilized for all or a portion of the lens 4 to scatter light from electric light bulb 12 to increase side visibility. Maintaining the center area of lens 4 transparent allows a focused beam to be projected as in a conventional flashlight. This allows the user to illuminate areas ahead during use. The configuration of the electric light bulb, reflector,and lens assembly in the opposite end of housing I is identical to that described above except spring 10 is not required as the positive terminal of battery 8 can make direct contact with electric light bulb 16. Changing batteries is a simple procedure of unscrewing either lens, removing the respective reflector assembly, and removing depleted batteries. New batteries are replaced in the reverse manner.

Figure 6:
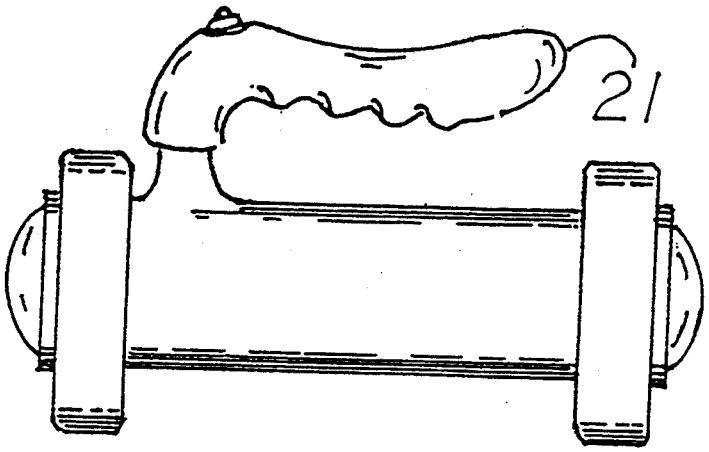
FIG. 6 is an elevation view of an alternative embodiment showing an alternative holding means.

FIG. 6 is another embodiment of the present invention which incorporates a L-shaped handle 21. The contoured shape of the handle may be integral with the handle or provided by a grip covering.

Figure 7:
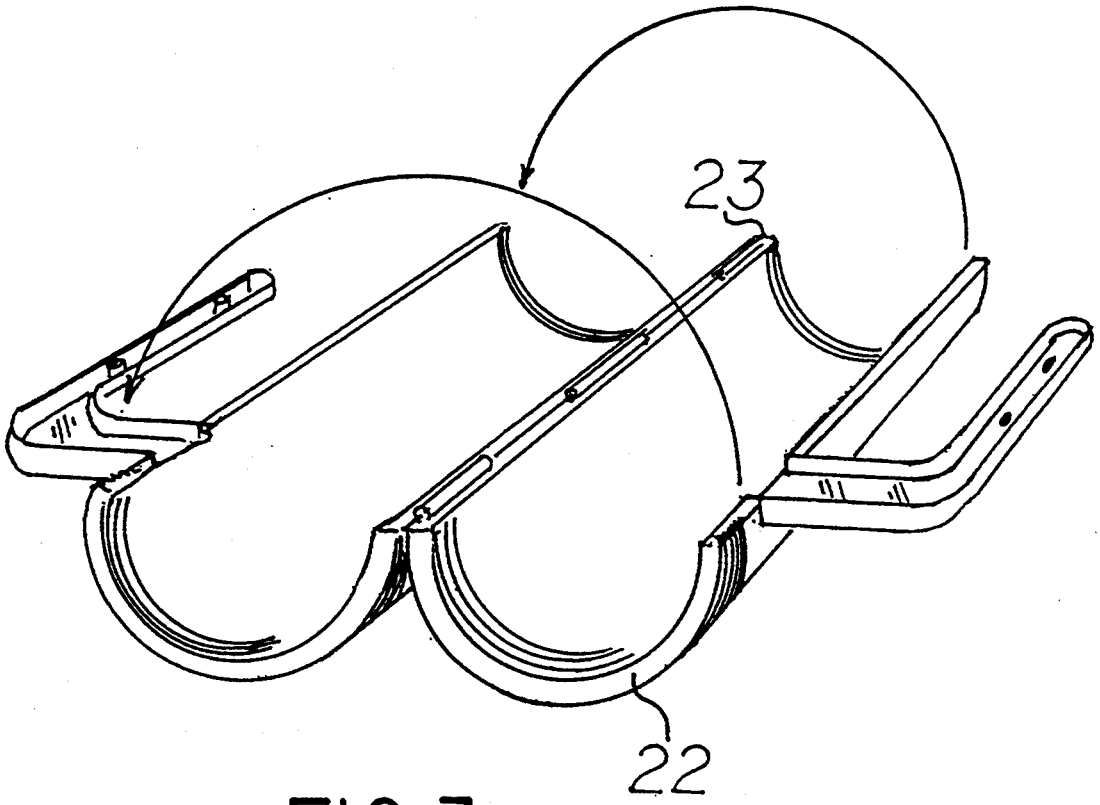
FIG. 7 is a perspective view of a method of housing construction of the present invention.

FIG. 7 illustrates a possible method of manufacture and assembly of the housing of the present invention. The housing and integral handle halves 22 would be molded or die cast of plastic or similar material as one piece connected by integral hinges 23. The unit would be assembled by rotating the body halves about the hinges and secured by snap latches or screws (not shown).

Figure 8:
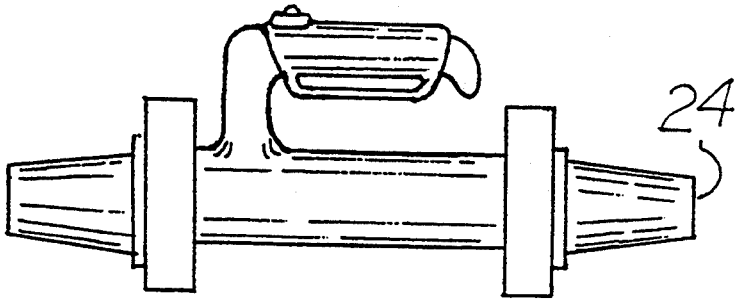
FIG. 8 is a elevation view showing alternative lens design of the present invention.

FIG. 8 is another embodiment of the present invention incorporating cone shaped lenses 24. Many sizes, shapes, and materials of construction are possible in the design of the lenses to suit additional purposes, style, and personal preferences of the user.

Figure 9:
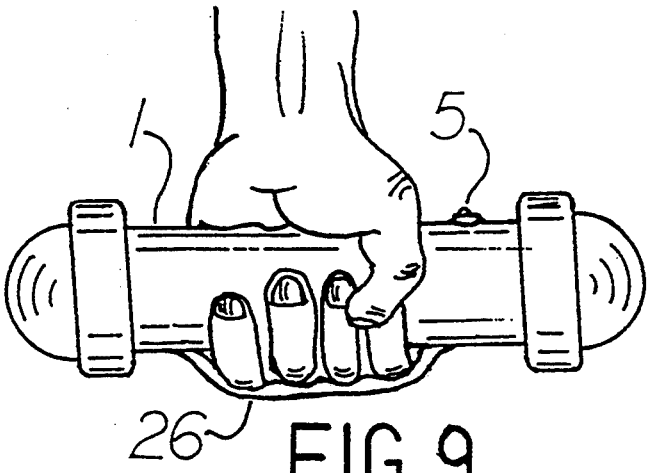
FIG. 9 is a perspective of yet another embodiment of the present invention showing an alternative holding means.

FIG. 9 is yet another embodiment of the present invention. The housing 1 is also used as the handle, while strap 26 adds security and reduces hand fatigue. Switch 5 is located on the housing.

Figure 10:
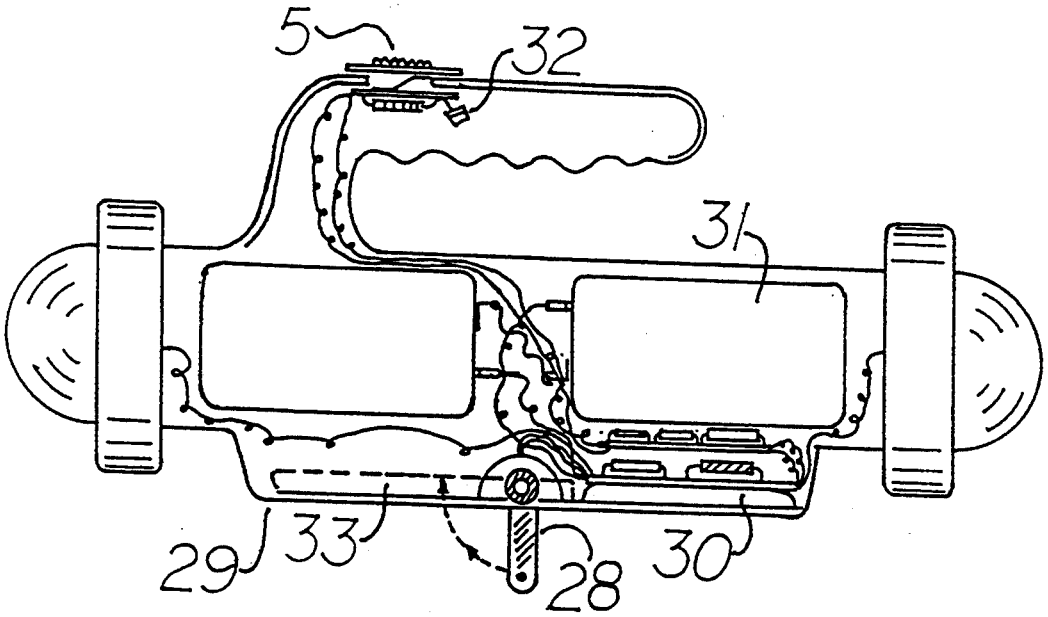
FIG. 10 is a cross section of yet another embodiment of the present invention incorporating a recharging means to the device.

FIG. 10 incorporates a recharging means in the present invention. Electrical plug 28, which is capable of being plugged into a household convenience outlet, is pivotally mounted on a housing extension 29, and supplies household current to recharging module 30. The recharging module reduces and rectifies the voltage, and controls charging current to rechargeable electro-chemical cells 31. A charge indicator 32 may be incorporated into the switch 5 or housing to indicate the state of the recharging. Electrical plug 28 may be pivoted into a recess 33 of housing extension 29 during use of the device.

Some variations are possible to accommodate different style electric light bulbs, and it is within the capabilities of one skilled in the art to effect these.

It is also within the capabilities of one skilled in the art to modify the internal arrangement to connect the electric light bulbs in an electrical parallel arrangement instead or series as described above. Although this would complicate the arrangement slightly, it would allow one bulb to operate if the other bulb failed.

It is also within the capabilities of one skilled in the art to incorporate alternate light sources such as a fluorescent bulb (or bulbs) to increase battery life, or strobe flash modules to increase visibility still further.

It is also within the capabilities of one skilled in the art to incorporate alternate attaching means for the weights, such as friction fit, and ball and detent methods.

I claim:

1. A handheld aerobic safety device having removable first and second dumbbell weights, the device comprising:

(a) a housing, generally oblong in shape, comprising a front end and a back end;

(b) a first lens for dispersing light in a plurality of directions, the first lens disposed in said front end of said housing;

(c) a second lens for dispersing light in a plurality of directions, the second lens disposed in said back end of said housing;

(d) said removable first dumbbell weight comprising an opening sufficient in size to fit over said first lens;

(e) said removable second dumbbell weight comprising an opening sufficient in size to fit over said second lens;

(f) an attachment means on said housing for securing said removable first dumbbell weight and said removable second dumbbell weight to said housing so that said first lens extends outward beyond said removable first dumbbell weight and said second lens extends outward beyond said removable second dumbbell weight; and (g) a second attaching means on said housing, said second attaching means separate from said first attaching means wherein said removable first dumbbell weight and said removable second dumbbell weight can be removed from said housing while said first lens and said second lens remain attached to said housing.

2. The device of claim 1 wherein said removable first dumbbell weight and said removable second dumbbell weight further comprise an internal attachment thread disposed in said opening of said removable first dumbbell weight and said removable second dumbbell weight, sand said attachment means comprises an external attachment thread on said front end and said back end of said housing.

3. The device of claim 2 wherein said removable first dumbbell weight and said removable second dumbbell weight are covered by a resilient material.

4. The device as in claim 1 wherein said housing comprises an electric light bulb at said front end of said housing and a second electric light bulb at said back end of said housing, at least one electrochemical battery cell, a switch and a connecting means between said electric light bulbs, said battery cell, and said switch.

5. The device of claim 4 wherein said electro-chemical battery cell is rechargeable and the device further comprises a recharging means to restore electrical charge to said cell, and said housing further comprises an electrical plug means which is pivotally mounted to said housing and can be plugged into a household electrical convenience outlet to supply energy for said recharging means.

6. The device as in claim 4 wherein said housing further comprises at least one reflector disposed at said front end and said back end of said housing to concentrate light from said electric light bulbs.

7. The device as in claim 6 wherein at least one said lens comprises a transparent center portion, said center portion allowing a conical beam of light to be emitted as in a conventional flashlight.

8. The device of claim 1, in which said housing further comprises a flexible strap having a first end and a second end and attached to said housing at said first end and said second end housing and said strap being of such length for allowing a hand if a user to fit between said housing and said strap.

9. The device as in claim 1, wherein said housing further comprises a handle means for holding the device.

10. The device of claim 9 in which said handle means comprises an inverted generally U-shaped member having two legs and a hand section having a long axis positioned such that both said legs of said handle are connected with said housing and such that said long axis of said hand section of said handle is generally aligned with a long axis of said housing.

11. The device of claim 9 in which said holding means comprises a generally L-shaped member having a short leg and a long hand section having a long axis and said short leg is attached to said housing such that said long axis of said long hand section is generally aligned to said long axis of said housing.

* * * * *